United States Patent [19]

Horst

[11] 4,381,604

[45] May 3, 1983

[54] VIBRATING SCRAPER

[76] Inventor: Milton C. Horst, 1614 S. Lipscomb, Amarillo, Tex. 79102

[21] Appl. No.: 264,972

[22] Filed: May 18, 1981

[51] Int. Cl.[3] ..... B26B 3/00

[52] U.S. Cl. ..... 30/169; 30/500; 30/45; 15/236 R

[58] Field of Search ..... 30/45, 334, 336, 337, 30/500, 34 R, 42, 44, 164.9, 169, 272 A, 272 R, 296 R, 394; 15/236 R, 93 R; 145/4

[56] References Cited

U.S. PATENT DOCUMENTS

| | | | |
|---|---|---|---|
| 403,625 | 5/1889 | Thompson | 30/169 |
| 2,105,960 | 1/1938 | L'Wolfe | 15/236 R |
| 2,236,323 | 3/1941 | Stachowiak | 30/169 |
| 3,008,232 | 11/1961 | Shea, Jr. | 30/45 |
| 3,395,414 | 8/1968 | Malin | 15/93 R |

FOREIGN PATENT DOCUMENTS

| | | | |
|---|---|---|---|
| 554421 | 3/1958 | Canada | 15/236 R |

OTHER PUBLICATIONS

*Electric Engravers,* Acme-Burgess, 1980.

*Primary Examiner*—James G. Smith
*Assistant Examiner*—Debra S. Meislin
*Attorney, Agent, or Firm*—Wendell Coffee

[57] ABSTRACT

A razor blade holder includes a base plate and a top jaw. A cylindrical sleeve is attached to the base plate by two loops on the back of the base plate going under the cylindrical sleeve and one loop on the back of the plate over the cylindrical sleeve. A holding screw extends through a hole in the top jaw into a tapped hole in the base plate. The top jaw is curved from the front to the back so that tightening the holding screw will tightly hold the razor blade located between the base plate and the top jaw. A set screw radially in the sleeve secures the sleeve to the engraving point of a vibrating engraver. Therefore, operation of the engraver will vibrate the blade to aid in the scraping action.

4 Claims, 3 Drawing Figures

VIBRATING SCRAPER

CROSS REFERENCE TO RELATED APPLICATIONS

None, however, Applicant has filed Disclosure Document #90,389 on May 1, 1980, which document concerns this Application; therefore, by separate paper, it is respectfully requested that the Document be retained and acknowledgement thereof made by the Examiner.

BACKGROUND OF THE INVENTION (1) Field of the Invention

This invention relates to scrapers and more particularly to a vibrating holder for a razor blade having particular utility for scraping paint from glass windows.

(2) Description of the Prior Art

When painting houses, many people, particularly amateurs get paint upon the windows. Removing this paint is particularly difficult. The common practice is to scrape the paint from the windows with a paint scraper in the form of a razor blade. Hand holders have been invented to hold the blade so it can be conveniently used for this purpose.

Generally, scrapers are useful in scraping foreign matter from hard surfaces. Again, razor blades are widely used for this purpose. Before this application was filed, applicant caused a search to be made in the United States Patent and Trademark Office. The following U.S. Pat. Nos. were found on this search: ASPEEK 2,722,072, BRIGGS 2,240,755, JOHNSON 2,737,717, LIESUNAITIS 2,821,017, MALIN 3,395,414, McCARTY 1,813,630.

MALIN discloses a scraper for finishing the beds of machine tools. The vibration is rectalinear and normal to the edge of the tool, which does not appear to be a sharp scraper.

McCARTY discloses an electrical magnetic oscillator attached to a domestic utensil, such as toothbrush, nail file or razor blade.

LIESUNAITIS discloses a hand holder for holding a scraping blade which appears to be similar to a razor blade. However, LIESUNAITIS indicates that his handle is to be gripped by both hands, therefore the blade seems to be larger than a razor blade and is not shown as a sharp blade.

JOHNSON discloses a paint scraper which is attached to a heater to heat and thus soften the paint before being scraped.

ASPEEK shows a scraper having a side to side oscillating motion or a circular oscillating motion.

BRIGGS is of general interest only.

SUMMARY OF THE INVENTION

New and Different Function

I have invented an attachment which can be readily and easily attached to the most inexpensive vibrating engravers. Vibrating engravers are commonly and inexpensively on the market or having a rod-like engraving point which reciprocates or vibrates in an axial direction. They are widely owned by homeowners to mark household items with identification to prevent the theft thereof. According to my invention a simple attachment is made to attach to this common household tool. The scraping of material from glass represents a difficult task. I have found, by having the rectalinear reciprocation of the blade as produced by these engravers that the task is made far easier and quicker.

Basically, my invention is to have a razor blade holder which has a sleeve, which fits snugly around the engraving point. The sleeve is held securely in place on the engraving point by a set screw. Therefore, it is not necessary to provide a special chuck or have a special type engraving tool to use my invention.

Thus it may be seen that the total function of my invention far exceeds the sum of the function of the individual parts such as sleeves, set screws, lugs, prongs, etc.

Objects of This Invention

An object of this invention is to scrape foreign material from hard surfaces.

Further objects are to achieve the above with a device that is sturdy, compact, durable, lightweight, simple, safe, efficient, versatile, ecologically compatible, energy conserving, and reliable, yet inexpensive and easy to manufacture, install, operate and maintain.

The specific nature of the invention, as well as other objects, uses, and advantages thereof, will clearly appear from the following description and from the accompanying drawing, the different views of which are not scale drawings.

DESCRIPTION OF THE PREFERRED EMBODIMENT

Figure 1:
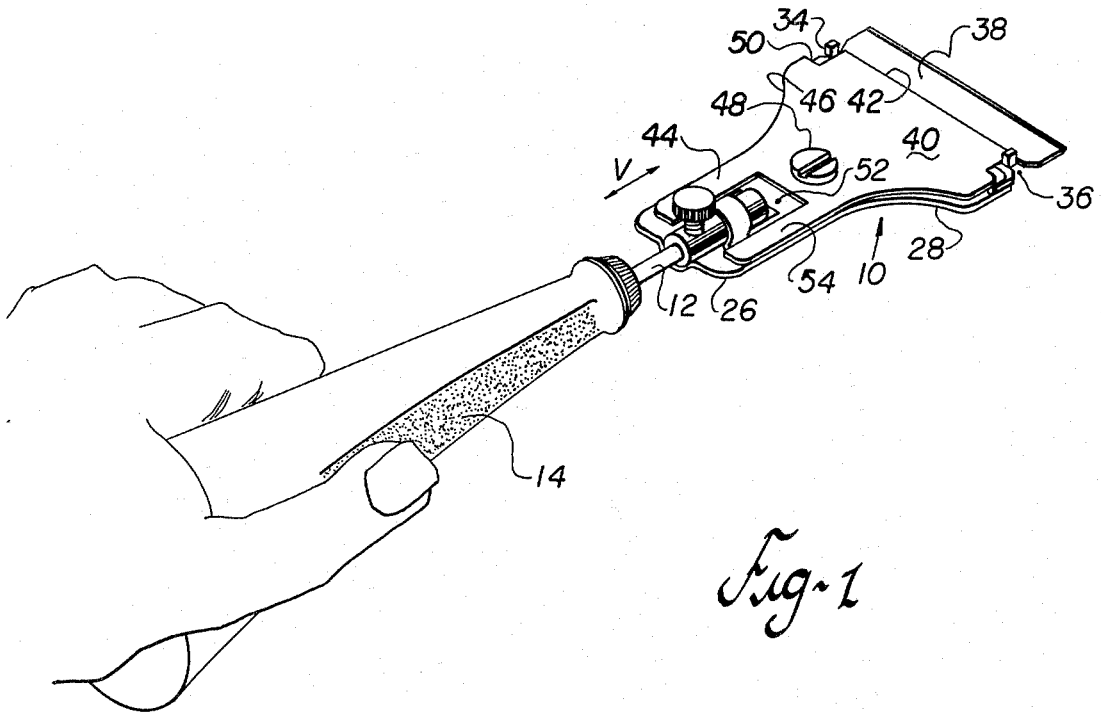
FIG. 1 is a perspective of an embodiment of a holder according to this invention, with a razor blade attached to the holder and the holder attached to the engraving point of a vibrating engraver.

The paint scraper includes holder 10 which is attached to engraving point 12 of vibrating engraver 14.

The holder 10 includes cylindrical sleeve 16 which is closed at one end so that it could be described as a cup. Axial bore 18 extends from the back of the sleeve. The bore 18 telescopes over the engraving point 12 and forms a snug fit therewith. Set screw 20 is threaded through a radial tapped hole in the sleeve. Therefore the set screw 20 extending radially through the one side of the sleeve 16 and secures the sleeve to the engraving point 12.

Base plate 22 has a front 24, back 26, and two sides 28. Two loops 30 are struck from the back 26 of the base plate. When the holder 10 is assembled, loops 30 extend under the sleeve 16. One loop 32 is struck from the back of the base plate 22 and when assembled extends over the sleeve 16. As seen in the drawing, the loops 30 and 32 are circumferential of the sleeve 16. At least one of the loops (and preferably one of the loops under the sleeve 16) are fixed as by spot welding to the sleeve 16 so that the base plate 22 is permanently attached to the sleeve 16. Lug 34 is struck from each side of the base plate 22 near the front 24 thereof. These lugs 34 extend upward from the base plate 22. When razor blade 38 is upon the base plate, the lugs will engage notches 36 in the razor blade 38 to hold the razor blade in the proper position on the front 24 of the base plate 22.

Top jaw 40 has a front 42, back 44, and two sides 46. A hole is drilled and tapped through the base plate 22 at about the center thereof. A corresponding hole is made through the top jaw 40 at about the center thereof. Holding screw 48 extends through the hole in the top jaw 40 and is threaded into the tapped hole of the base plate 22 to secure the top jaw to the base plate. The front 42 of the top jaw will be over the front 24 of the base plate 22. A notch 50 is formed at the front corner of each side 46 of the top jaw. When the parts are assembled, the lugs 34 will mate with the notches 50 of the top jaw as well as the notches 36 of the razor blade. Stated otherwise, the top jaw will mate with the base plate at this area.

Slot 52 in the back of the top jaw 40 forms two prongs 54. The top jaw 40 is curved and arches up and away from the base plate 22 at the center where the holding screw 48 is. Each of the prongs 54 bears against the back 26 of the base plate at pressure point 56.

Tightening the holding screw 48 presses the prongs 54 against the back of the base plate and the front 42 of the jaws against the front 24 of the base plate. Of course, if a razor blade 38 is interposed between the base plate and the top jaw, the tightening the holding screw 48 will securely hold the razor blade in place.

The top jaw, base plate, and holding screw form a holding assembly.

Figure 2:
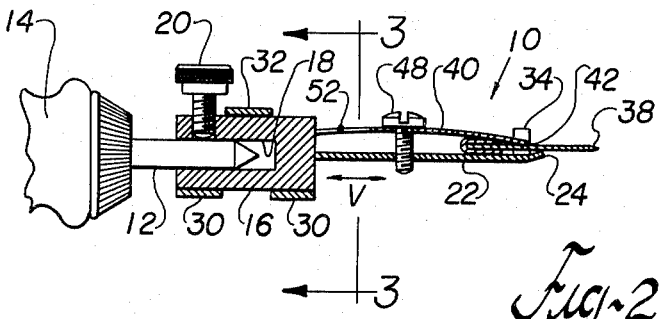
FIG. 2 is an axial sectional view thereof.
Figure 3:
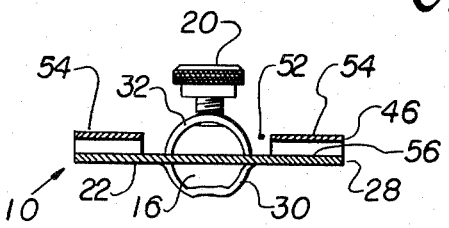
FIG. 3 is a sectional view thereof taken substantially on line 3—3 of FIG. 2.

In operation, it will be understood, that the vibrating engraver 14 will empart a rectilinear reciprocating vibration to the engraving point 12. This is shown by the doubleheaded arrow V in FIGS. 1 and 2. This axial rectilinear vibration will be transmitted through the holder 10 to the razor blade 38 thereby producing a rectilinear vibration on the razor blade to quickly scrape paint or other foreign material which might be adhered to glass or other hard surfaces.

Thus it may be seen that I have provided a tool readily adapted to scrape paint from glass in a simple, inexpensive, expedient manner.

The embodiment shown and described above is only exemplary. I do not claim to have invented all the parts, elements or steps described. Various modifications can be made in the construction, material, arrangement, and operation, and still be within the scope of my invention.

The limits of the invention and the bounds of the patent protection are measured by and defined in the following claims. The restrictive description and drawing of the specific example above do not point out what an infringement of this patent would be, but are to enable the reader to make and use the invention.

As an aid to correlating the terms of the claims to the exemplary drawing, the following catalog of elements is provided:

10 holder;
12 engraving point;
14 vibrating engraver;
16 sleeve;
18 axial bore;
20 set screw;
22 base plate;
24 front (base plate);
26 back (base plate);
28 side (base plate);
30 two loops;
32 one loop;
34 lug;
36 notches (razor blade);
38 razor blade;
40 top jaw;
42 front (jaw);
44 back (jaw);
46 side (jaw);
48 holding screw;
50 notches (jaw);
52 slot;
54 prongs;
56 pressure point.

I claim as my invention:

1. A holder for holding a razor blade adapted to be attached to a vibrating engraver comprising:

a. a cylindrical sleeve,
b. an bore in the sleeve,
c. a set screw radially in the sleeve,
d. a base plate having a front, back and two sides,
e. two loops on the back of the base plate circumferentially under the cylindrical sleeve,
f. one loop on the back of the base plate circumferentially over the cylindrical sleeve,
g. at least one of said loops fixed as by welding to the sleeve so that the base plate is permanently attached to the sleeve,
h. a lug on each side of the base plate extending upward therefrom, said lugs adapted to engage notches in a razor blade to be held in the front of the base plate,
i. a tapped hole through the base plate at about the center thereof,
j. a top jaw having a front, back, and two sides,
k. a hole through the top jaw at about the center thereof,
l. a holding screw through the hole in the top jaw and threaded into the tapped hole of the base plate to secure the top jaw to the base plate with the front of the top jaw over the front of the base plate,
m. a notch at the front corner of each side of the top jaw so that the top jaw mates with the base plate at this area,
n. a slot in the back of the top jaw forming
o. two prongs which straddle the sleeve, and
p. the jaws being curved with the center at the holding screw arched away from the base plate, so that
q. tightening the holding screw will press the prongs against the base plate and the front of the jaw against the front of the base plate.

2. The holder as defined in claim 1 including limitations a through q further comprising:

r. a razor blade between the base plate and jaw,
s. said razor blade having a notch on the sides thereof,
t. said lugs on base plate fitting within the notches on the razor blade.

3. The holder as defined in claim 1 having limitations a through q further comprising:

r. a vibrating engraver,
s. an engraving point on said vibrating engraver,
t. said cylindrical sleeve telescoped over said vibrating point,
u. said set screw securing the sleeve and thus the holder onto the engraving point.

4. A paint scraper comprising:

a. a vibrating engraver,
b. a rod-like engraving point mounted in said engraver,
c. said engraving point adapted to vibrate axially,
d. a cylindrical sleeve,
e. an bore in the sleeve telescoped over the engraving point,
f. a set screw radially in the sleeve securing the sleeve on the engraving point,
g. a base plate having a front, back, and two sides,
h. two loops on the back of the base plate circumferentially under the sleeve, i. one loop on the back of the base plate circumferentially over the sleeve, j. at least one of said loops fixed as by welding to the sleeve so that the base plate is permanently attached to the sleeve, k. a lug on each side of the base plate extending upward therefrom, l. a razor blade having a notch in each side thereof, m. said lugs engaging the notches in the razor blade, n. a tapped hole through the base plate at about the center thereof, o. a top jaw having a front, back and two sides, p. a hole through the top jaw at about the center thereof, q. a holding screw through the hole in the top jaw, and threaded into the tapped hole of the base plate to secure the top jaw to the base plate with the front of the jaw over the front of the base plate, r. a notch at the front corner of each side of the top jaw so that the top jaw mates with the base plate at this area, s. a slot in the back of the top jaw forming two prongs which straddle the sleeve, and t. the jaw being curved with the center at the holding screw arched away from the base plate, u. the front of the jaw pressing the razor blade against the front of the base plate, and v. the two prongs pressed against the base plate when the holding screw is tightened.

* * * * *